US006401821B1

(12) United States Patent
Kennedy et al.

(10) Patent No.: US 6,401,821 B1
(45) Date of Patent: Jun. 11, 2002

(54) METHOD AND APPARATUS INVOLVING AN INTEGRATED OR OTHERWISE COMBINED EXIT GUIDE AND SECTION MILL FOR SIDETRACKING OR DIRECTIONAL DRILLING FROM EXISTING WELLBORES

(75) Inventors: Michael D. Kennedy, Houston; Neil D. Shappert, Missouri City, both of TX (US)

(73) Assignee: Re-Entry Technologies, Inc., Houston, TX (US)

( * ) Notice: Subject to any disclaimer, the term of this patent is extended or adjusted under 35 U.S.C. 154(b) by 0 days.

(21) Appl. No.: 09/583,153

(22) Filed: May 30, 2000

Related U.S. Application Data

(60) Provisional application No. 60/171,903, filed on Dec. 23, 1999.

(51) Int. Cl.[7] ..... E21B 7/08; E21B 29/06

(52) U.S. Cl. ..... 166/313; 166/55.7; 166/117.6; 166/297

(58) Field of Search ..... 166/297, 313, 166/50, 55, 55.1, 55.7, 117.5, 117.6

(56) References Cited

U.S. PATENT DOCUMENTS

| | | | | |
|---|---|---|---|---|
| 5,467,820 A | * | 11/1995 | Sieber | 166/117.6 |
| 5,584,350 A | * | 12/1996 | Schnitker et al. | 175/61 |
| 5,806,595 A | * | 9/1998 | Langford et al. | 166/298 |
| 5,806,600 A | * | 9/1998 | Halford, Sr. | 166/382 |
| 6,024,168 A | * | 2/2000 | Kuck et al. | 166/297 |

* cited by examiner

*Primary Examiner*—David Bagnell
*Assistant Examiner*—Jennifer H Gay
(74) *Attorney, Agent, or Firm*—The Matthews Firm

(57) ABSTRACT

A combined casing mill and whipstock or other exit guide is positioned in a drill string assembly used to mill a section of steel casing, which as the section mill mills along the section of casing, allows the exit guide to be transported adjacent the milled-out casing and allows a drill bit and drill string to be run along the surface of the exit guide and into the earth formation. In an alternative embodiment, the combination of the section mill with the exit guide is used in open hole operations having no casing.

16 Claims, 6 Drawing Sheets

METHOD AND APPARATUS INVOLVING AN INTEGRATED OR OTHERWISE COMBINED EXIT GUIDE AND SECTION MILL FOR SIDETRACKING OR DIRECTIONAL DRILLING FROM EXISTING WELLBORES

RELATED APPLICATION

This Application claims priority from United States Provisional Patent Application Serial No. 60/171,903, filed Dec. 23, 1999.

FIELD OF INVENTION

This invention relates, generally, to method and apparatus for the sidetracking or directional drilling from existing wellbores, cased or uncased, and more specifically, to the sidetracking or directional drilling of such wells which may or may not be required to be oriented in a predetermined direction from such existing wells.

BACKGROUND OF THE INVENTION

It is well known in the art to exit existing wellbores which may be vertical or angled from the vertical. Such exit wells may be drilled merely to sidetrack the existing wellbores, or may be used for directional drilling. Such exit wells may be drilled at any angle or direction, predetermined or unknown, from the existing wellbores.

In the conventional art, when the existing wellbore is cased, typically with a steel casing, it is known to remove a section of the casing to allow the drill bit to begin cutting the exit well, or to merely cut a window in the steel casing and use a whipstock to direct the drill bit into the adjacent formation. The use of such whipstocks is well-known in the art, for example, in the following United States patents:

U.S. Pat. No. 5,109,924

U.S. Pat. No. 5,551,509

U.S. Pat. No. 5, 647,436

U.S. Pat. No. 4,182,423

U.S. Pat. No. 5,806,596

U.S. Pat. No. 5,771,972

U.S. Pat. No. 5,592,991

U.S. Pat. No. 5,636,692

Thus it has been conventional in this art to use a whipstock in conjunction with a so-called "window mill". With such configurations, the whipstock is oriented so that it will determine the direction in which the drill bit is eventually to be run through the window cut by the window mill and thus into the formation into which the exit well is to be drilled.

It is also known in this art to use a section mill but without a whipstock. When using the section mill, the mill is used to cut away an entire section of the casing, sometimes 80 to 100 ft. of the casing string, and then that section of the borehole from which the casing has been cut away is pumped full of cement. Once the cement has hardened, conventional sidetracking or directional drilling techniques can be used which do not depend upon the use of a whipstock. Such sectional mills are conventional and are available from various downhole tool companies. For example, a section mill is available from the Baker Oil Tools Division of Baker Hughes, Inc. located in Houston, Tex., such as their Model "D" Section Mill, Product No. 150-72. Such section mills known in this art typically use knives which are hydraulically operated to extend into and cut through the steel casing.

To the best of Applicant's knowledge, those in this art have neither recognized nor utilized a combination of a whipstock with a section mill.

BRIEF DESCRIPTION OF DRAWINGS

For a further understanding of the nature and objects of the present invention, reference should be had to the following brief description of the drawings, wherein.

DETAILED DESCRIPTION OF THE PREFERRED EMBODIMENT

Figure 1:
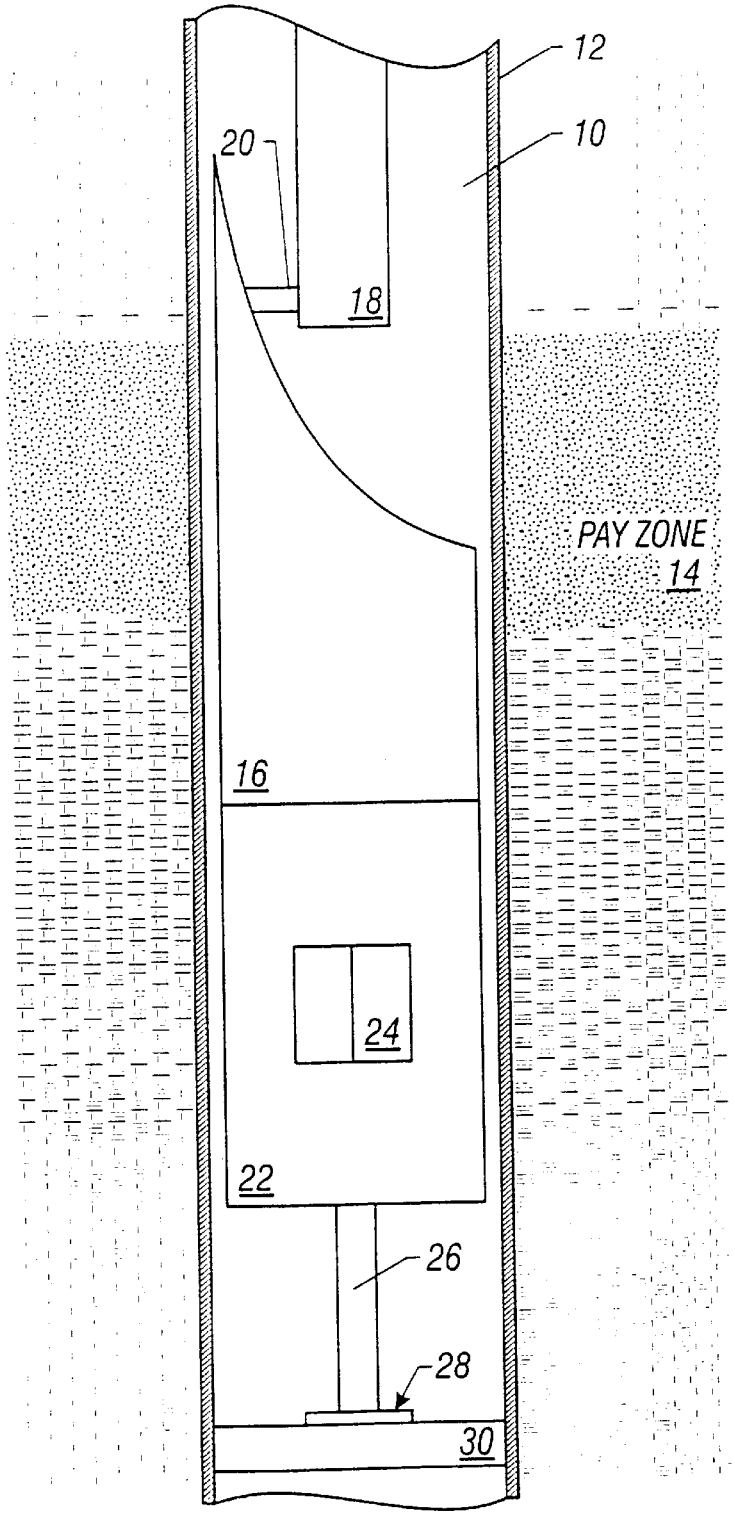
FIG. 1 (Prior Art)
FIG. 1 is an elevated, diagrammatic view, partly in cross section, of a whipstock apparatus known in the prior art which is used to drill into a pay zone through a window in a casing wall.

Referring now to the drawings in more detail, FIG. 1 illustrates a cased borehole 10 having a steel casing 12 which traverses a pay zone 14 into which a horizontal well is proposed to be drilled. In the practice of the prior art illustrated in FIG. 1, a whipstock 16 is run into the cased borehole 10 by the use of a tubular, for example, a string of drill pipe 18 which is connected to the whipstock 16 by a shear pin 20. Threadedly connected to the whipstock 16 is a sub 22 which has a pair of slips 24, only one of which is illustrated, with the other such slip being 180 degrees around the periphery of the sub 22. A piston rod 26 which travels within the interior of the sub 22 has its lower end a pedestal 28 which in use rests against a bridge plug 30, sometimes referred to as an anchor in this art, which is set within the casing 12.

In the use of the prior art system as illustrated in FIG. 1, the combination of the whipstock 16 and the slip sub 22 is run into the cased borehole 10 by running the drill pipe 18 into the borehole until the pedestal 28 sits down on the anchor 30. By continuing to lower the drill pipe 18 from the earth's surface, the piston rod 26 moves within the sub 22 to activate the slips 24 which causes them to engage against the side wall of the casing 12 and prevent further vertical movement of the combination. By continuing to lower the drill pipe 18, the shear pin 20 is sheared off and the drill pipe 18 can be removed from the borehole.

As is well-known in this art, one or more window mills are then attached to the drill pipe 18 and the window mills are then used to drill through the casing 12, forming a window. The drill pipe is then removed and a formation type drill bit is attached to the drill string 18 and the well is drilled off of the curvature of the whipstock 16 through the window, into the pay zone 14 as far as is desired.

Figure 2:
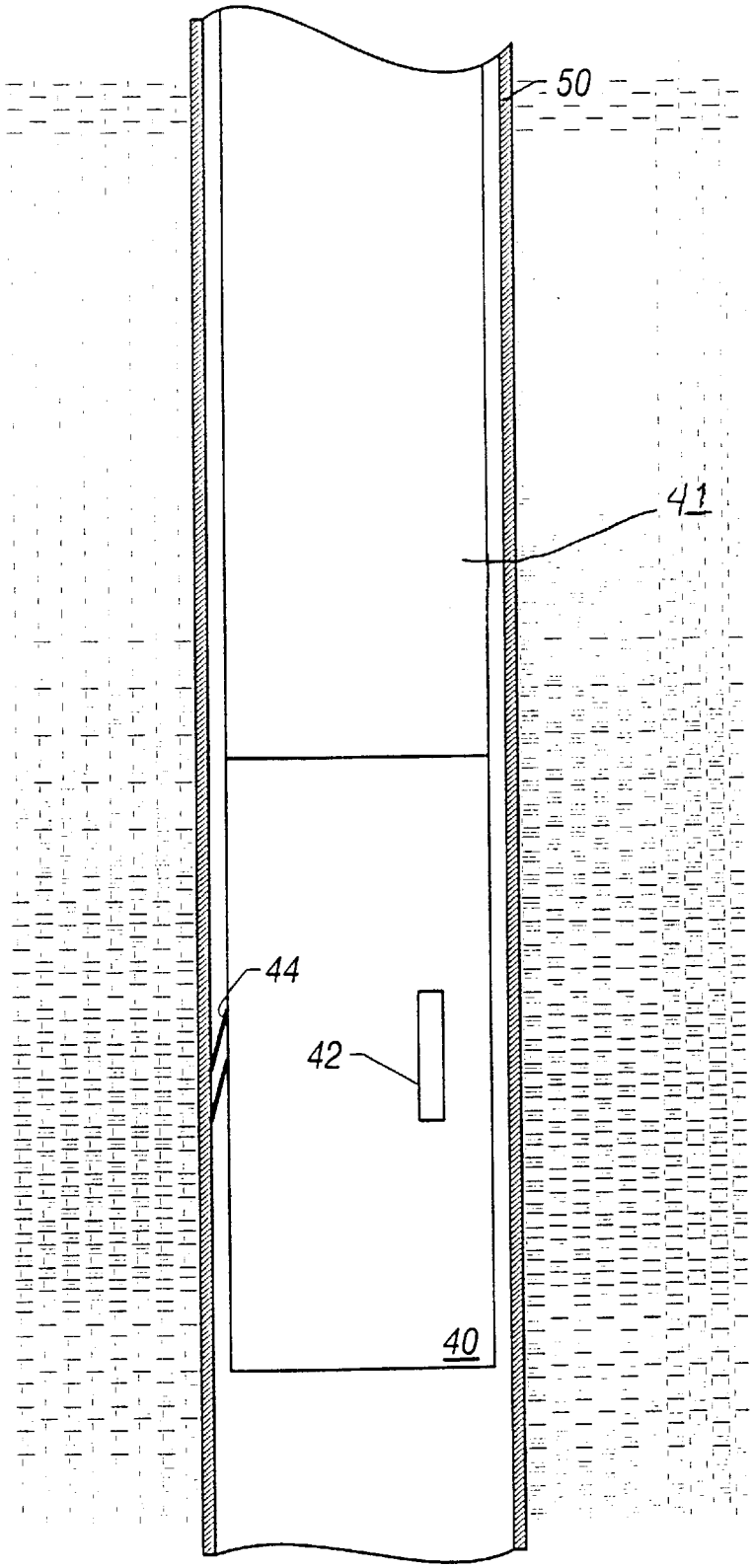
FIG. 2 (Prior Art)
FIG. 2 is an elevated, diagrammatic view, partly in cross section, of a section mill which is used in the prior art to cut away a section of the steel casing in a pre-existing well.
Figure 3:
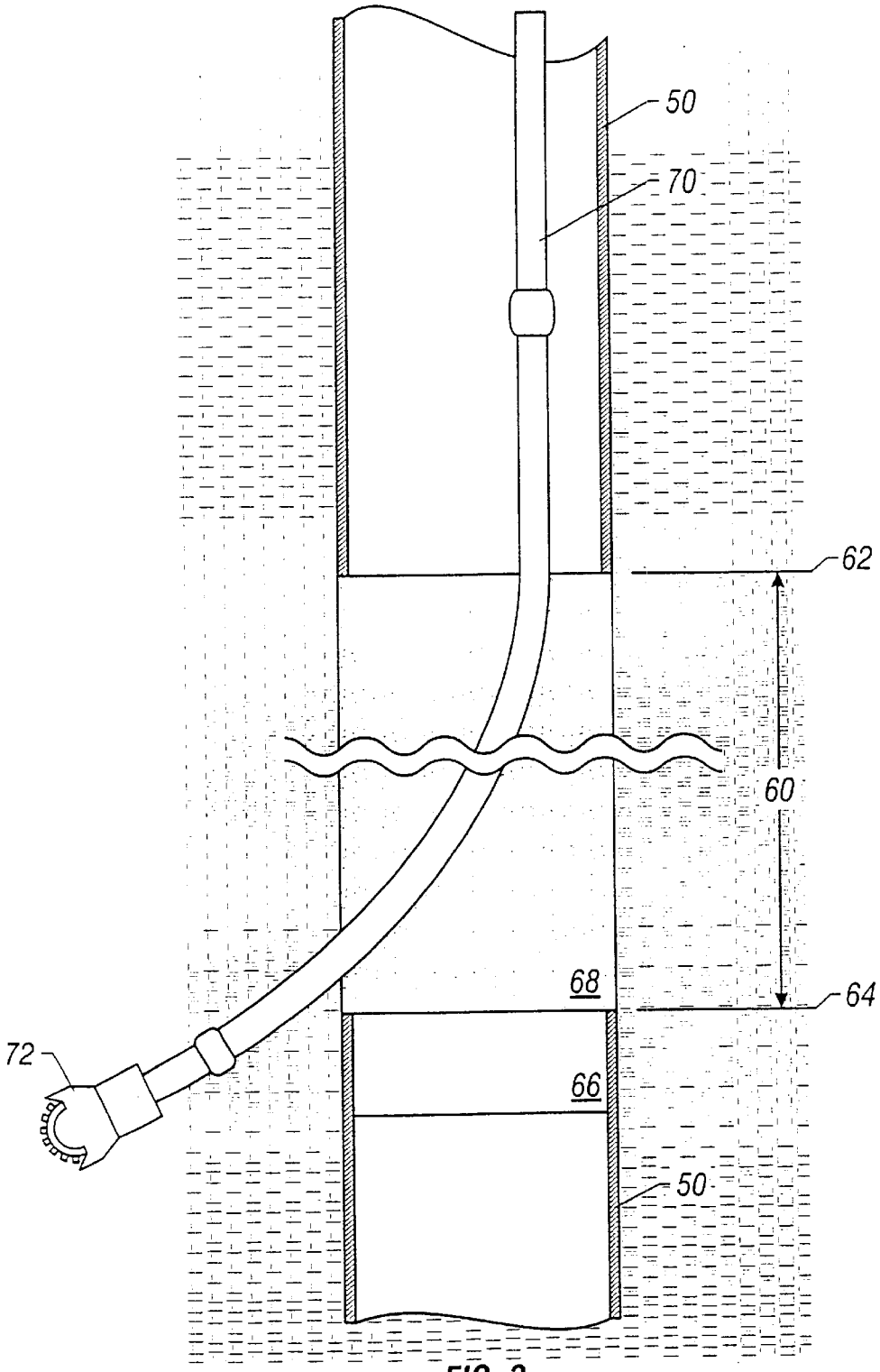
FIG. 3 (Prior Art)
FIG. 3 is an elevated view, partly in cross section, showing the manner in which the prior art has used the boreholes formerly cased, but cut away by the section mill illustrated in FIG. 2, and the manner in which directional drills are drilled through a section of concrete in a conventional manner.

Referring now to FIG. 2, an entirely different mode of operation is described in which a conventional section mill 40 is threadedly connected to a string of tubulars, for example, the drill pipe 41. When the desired depth is reached, a trio of blades 42, 44 and a non-illustrated third blade are hydraulically actuated using fluid from the earth's surface to expand and engage the casing 50. The blade a non-illustrated third blade is hidden in this view, being on the other side of the section mill 40. As is well-known in this art, the blades 42, 44 and a non-illustrated third blade must be cooled by liquid from the earth's surface to keep them from being destroyed merely by their action in cutting the casing 50. It is a common practice in the art that once the desired depth is reached by the apparatus illustrated in FIG. 2, the fluid pressure from the earth's surface is commenced, causing the blades 42, 44 and a non-illustrated third blade to expand into the casing 50 and commence cutting the casing 50. By rotating the drill pipe 41, the casing 50 is completely severed. Because the casing is cemented against the earth's formation, the remaining casing stays in place. Thereafter, merely by lowering the drill pipe 41, the blades 42, 44 and a non-illustrated third blade will cut away the casing 50 for as long as the drill pipe 41 continues to be lowered. A cement plug 66, illustrated in FIG. 3, is placed within the cased borehole to prevent the cement from going further into the borehole below the predetermined depth 64 along the casing 50. Cement 68 is then filled in the borehole between the points 62 and 64, identified as the distance 60 between those points, which typically will be on the order of 80 to 100 ft. As soon as the cement 68 has hardened, a drill string 70 having a drill bit 72 at its lower end is used to drill through the cement section 68 using conventional directional drilling techniques. Quite often, the portion of the drill string 70 being used to drill through the cement 68 has articulated joints which allows it to make the curvature illustrated in FIG. 3 to drill out through the cement 68 into the adjoining formation. The distance 60 must be quite lengthy when using this technique, for example, 80 to 100 ft., to allow the radius of curvature of the pipe 70 to coincide with the desired destination within the formations surrounding the cased borehole.

Figure 4:
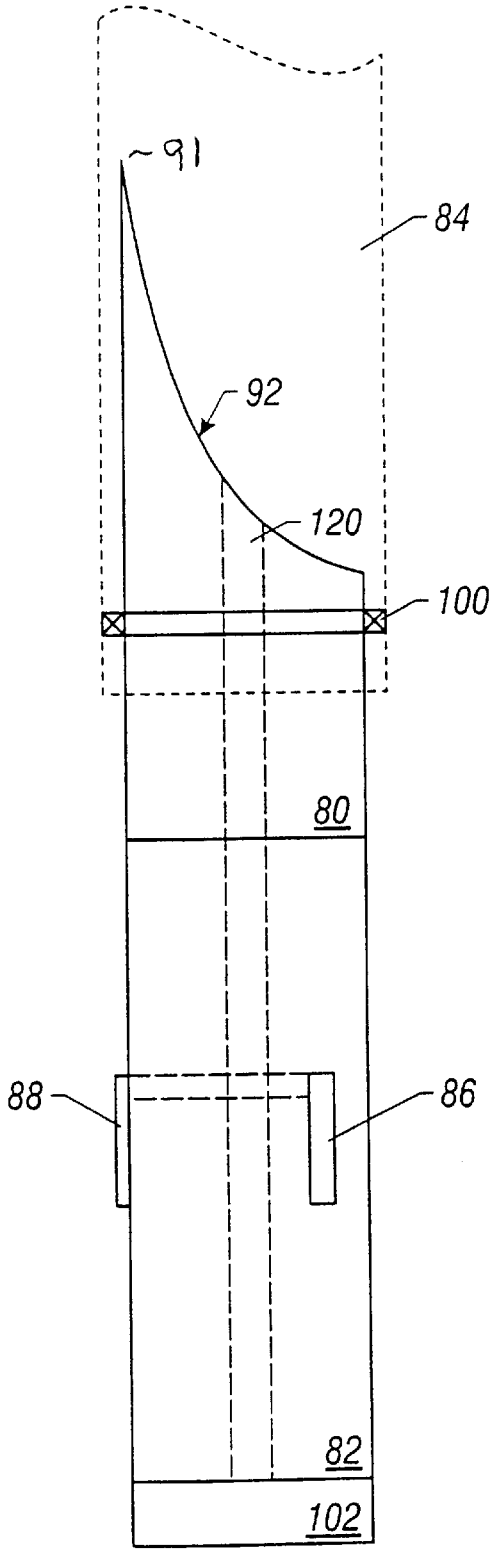
FIG. 4 is an elevated, diagrammatic view of the combination according to the present invention in which a whipstock or other exit guide is used with a section mill.

Referring to FIG. 4, there is illustrated the apparatus according to the present invention which includes a whipstock 80 or another conventional exit guide which is threadedly connected to a section mill 82. An on-off tool 84 is connected to a drill pipe such as the drill pipe 18 of FIG. 1 or the drill string 70 of FIG. 3 to run the whipstock and section mill 82 into the depth of interest within a cased borehole. When the depth of interest is reached, the blades 86, 88 and a third non-illustrated blade (with the third blade not being illustrated since it is hidden behind the section mill 82) are hydraulically actuated, thus causing the casing to be severed. By continually lowering the drill pipe and the on-off tool 84, the blades 86, 88 and the third blade, will cut away the casing, but for a much shorter distance, typically cutting away a length approximately the distance between the uppermost point 91 of the whipstock 80 and 2–3 ft. below the blades 86, 88 and the third blade. This causes the whipstock 80, and in particular its curved section 92, to be adjacent to the pay zone of interest, illustrated in FIG. 6. The blades 86, 88 and the third blade rest against the top portion of the casing, i.e., that portion of the casing which has yet not been cut away by the blades, so that the ceasing rotation of the drill pipe and the on-off tool 84, the blades 86, 88 and the third blade will merely rest against the top of the uncut away casing and prevent the tool from being lowered any further into the cased borehole. By adding additional weight to the drill pipe and the on-off tool 84, the shear pin or pins in the latch mechanism 100 will be sheared and the on-off tool 84 and drill pipe suspending the on-off tool 84 can be removed from the well, thus leaving the whipstock 80 and the section mill 82 in place within the borehole. The curved section 92 of the whipstock 80 thus being adjacent to the pay zone within the formation, a drill pipe and conventional drill bit can be lowered into the borehole and drilled into the adjacent formation as the drill bit and drill pipe runs against the curved surface 92 of the whipstock 80.

Referring to FIG. 4, there is illustrated the apparatus according to the present invention which includes a whipstock 80 or another conventional exit guide which is threadedly connected to a section mill 82. An on-off tool 84 is connected to a drill pipe such as the drill pipe 18 of FIG. 1 or the drill string 70 of FIG. 3 to run the whipstock and section mill 82 into the depth of interest within a cased borehole. When the depth of interest is reached, the blades 86, 88 and a third non-illustrated blade (with the third blade not being illustrated since it is hidden behind the section mill 82) are hydraulically actuated, thus causing the casing to be severed. By continually lowering the drill pipe and the on-off tool 84, the blades 86, 88 and the third blade, will cut away the casing, but for a much shorter distance, typically cutting away a length approximately the distance between the uppermost point 91 of the whipstock 80 and 2–3 ft. below the blades 86, 88 and the third blade. This causes the whipstock 80, and in particular its curved section 92, to be adjacent to the pay zone of interest, illustrated in FIG. 6. The blades 86, 88 and the third blade rest against the top portion of the casing, i.e., that portion of the casing which has yet not been cut away by the blades, so that the ceasing rotation of the drill pipe and the on-off tool 84, the blades 86, 88 and the third blade will merely rest against the top of the uncut away casing and prevent the tool from being lowered any further into the cased borehole. By adding additional weight to the drill pipe and the on-off tool 84, the shear pin or pins in the latch mechanism 100 will be sheared and the on-off tool 84 and drill pipe suspending the on-off tool 84 can be removed from the well, thus leaving the whipstock 80 and the section mill 82 in place within the borehole. The curved section 92 of the whipstock 80 thus being adjacent to the pay zone within the formation, a drill pipe and conventional drill bit can be lowered into the borehole and drilled into the adjacent formation as the drill bit and drill pipe runs against the curved surface 92 of the whipstock 80.

If it is desired to pull the apparatus illustrated in FIG. 4 out of the borehole, the on-off tool 84 threadedly connected to a drill pipe (not illustrated) can be run back into the borehole and can swallow up the whipstock 80 by engaging the latch mechanism 100. By then rotating the apparatus 80 and 82, without having the fluid pump at the earth's surface turned on, the blades 86, 88 and 90 will burn off from a lack of cooling and the drill pipe supporting the on-off tool 84 can then be withdrawn from the borehole since the blades 86, 88 and 90 will no longer be protruding against the casing wall.

Figure 5:
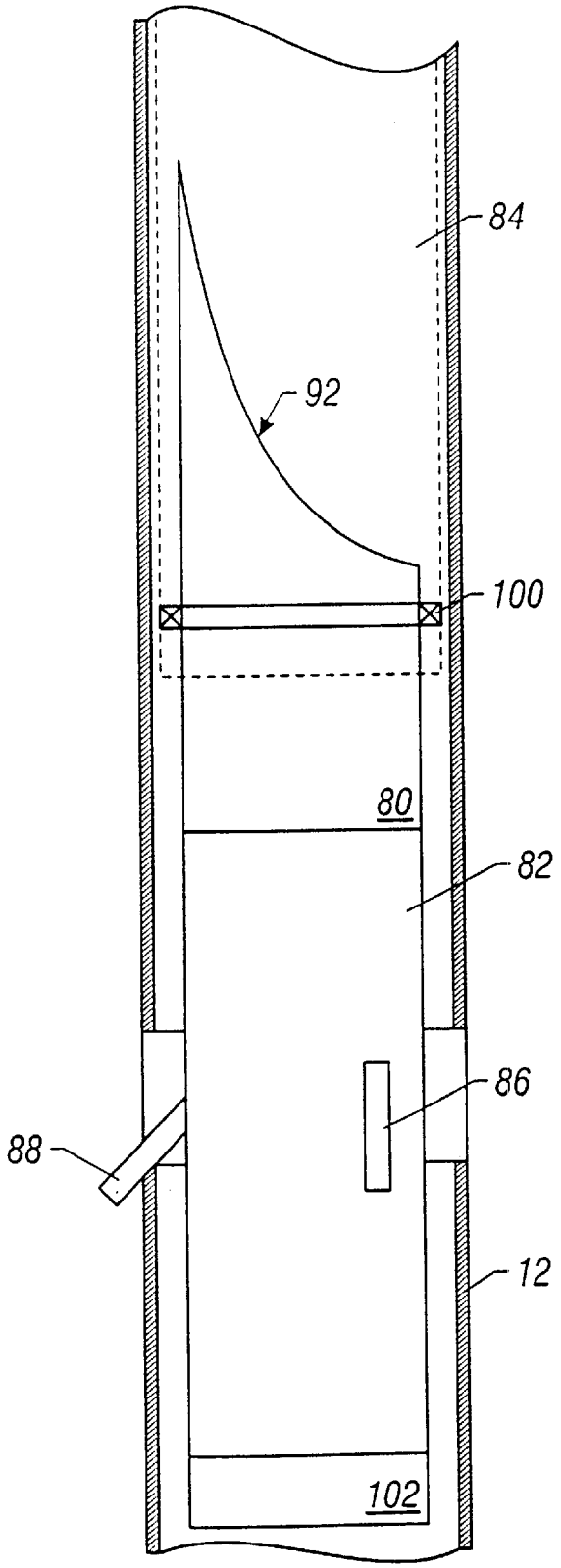
FIG. 5 illustrates in an elevated, diagrammatic view the initial cutting away of the casing in accord with the invention using the combination illustrated in FIG. 4.

Referring now to FIG. 5, the apparatus illustrated in FIG. 4, including the whipstock 80, the section mill 82 and the on-off tool 84, uses a cooling fluid, for example the drilling fluid used to drill the well, to pass from the earth's surface down through a string of drill pipe into the on-off tool 84 and then into a channel 120 formed in the interior of the whipstock 80 and down through the interior of the section mill 82 to provide cooling and the actuation of the section mill blades 86, 88 and 90. The fluid passing from the earth's surface down through the channel 120 can also be used to activate the optional packer assembly 102 to anchor the entire assembly against the casing walls if such an optional packer 102 is used. As is illustrated in FIG. 6 hereinafter, the optional packer assembly 102 is illustrated as having its member 122 expanded against the casing 12 to anchor the assembly at a given depth within the casing.

Referring again to FIG. 5, once the fluid has been pumped down from the earth's surface through the drill pipe and the on-off member 84, the blades 86, 88 and 90 will be moved hydraulically into the casing 12 and by rotaiting the drill pipe, the blades 86, 88 and 90 will at first sever the casing 12 and then as the assembly is lowered into the cased borehole, the blades 86, 88 and 90 will begin to cut away the casing material. In the stage illustrated in FIG. 5, the process has only begun.

Figure 6:
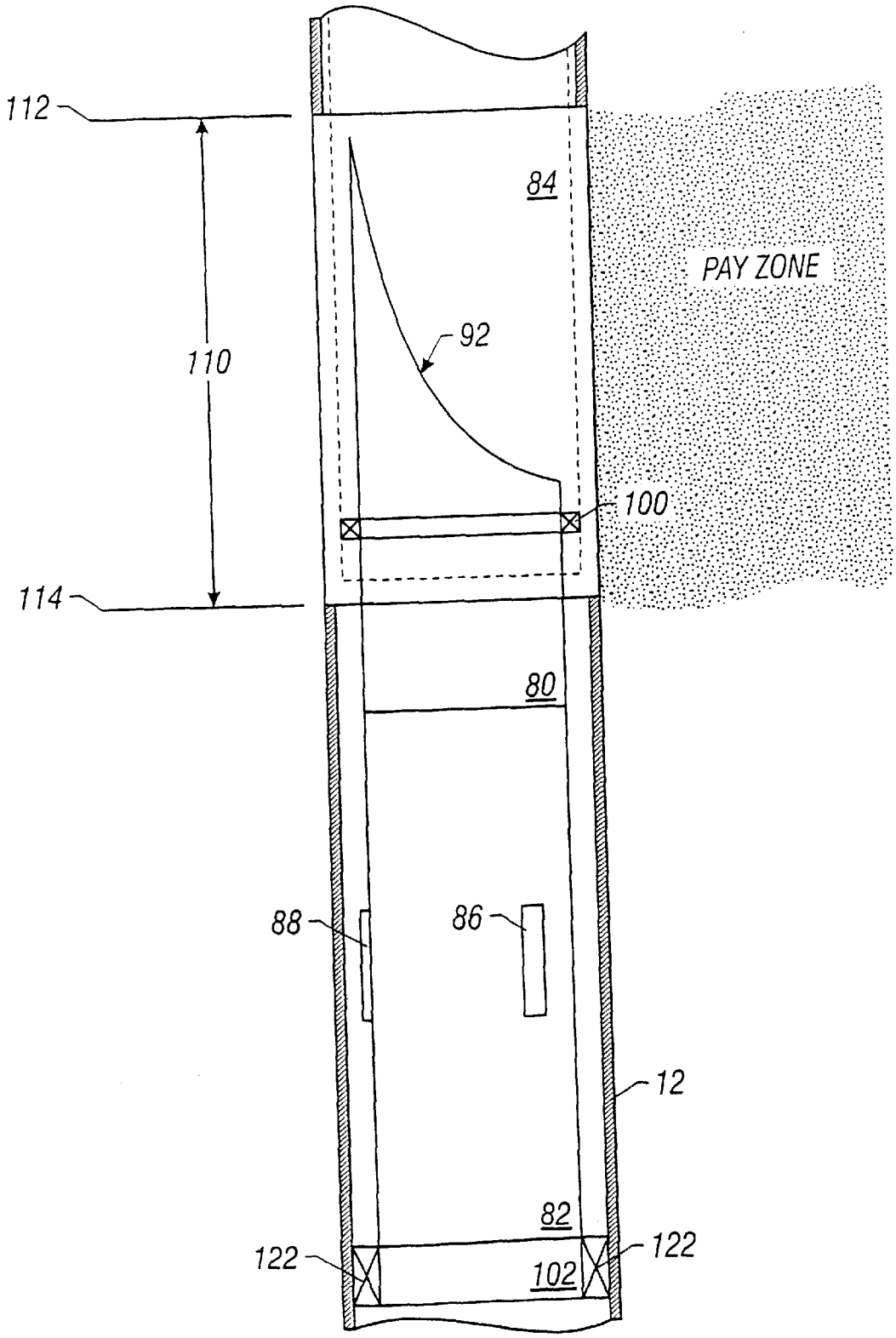
FIG. 6 illustrates in an elevated, diagrammatic view of the completed cutting away of the casing, and the lowering of the whipstock or other exit guide into position adjacent to the portion of the borehole from which the casing has been cut-away.

Referring now to FIG. 6, by continuing to lower the assembly comprised of the whipstock or other exit guide 80, the section mill 82 and the on-off tool 84, while rotating the drill pipe from the earth's surface, the casing 12 will be cut away by a distance which is totally dependent upon the depth to which the assembly has been lowered. In the preferred mode of the invention, the distance 100 is preferably determined to be approximately the distance between point 112 just above the uppermost point 91 of the whipstock 80 and 2–3 ft. below the blades 86, 88 and the third blade. After the casing has been cut away by the blades 86, 88 and the third blade to a predetermined depth, the entire assembly is lowered even further until the curved portion 92 of the whipstock is positioned adjacent to the pay zone as illustrated in FIG. 6. In the alternative embodiment, the further lowering of the assembly to bring the whipstock into proximity to the pay zone is accomplished by turning off the pumps at the earth's surface, thus causing the blades 86, 88 and the third blade to be burned off and to allow the section mill to traverse the cased borehole without further cutting of the casing. The whipstock is oriented in manners well-known in the art by rotating the drill pipe and determining the orientation of the whipstock by standard downhole surveying instrumentation. If the optional hydraulically set packer 102 is utilized, the pump pressure can be against turned on at the earth's surface to provide fluid to the packer 102 and set the packing element 122 to thereby anchor the assembly against the casing wall 12.

Although a packer 122 is mentioned as being optionally available for this process, such a packer need not be used since the blades 86, 88 and 90 can be resting on top of the uncut casing such as point 114 in FIG. 6 to prevent the apparatus from being lowered further into the cased borehole.

When it is desired to remove the whipstock and the section mill from the borehole, the on-off tool 84 can be run back into the borehole and reconnected onto the latch mechanism 100 which then allows the assembly to be picked up and removed from the borehole.

Thus, there has been described and illustrated herein the preferred embodiment of the present invention. Modifications to the preferred embodiment will be apparent to those skilled in the art from a reading of the foregoing detailed description and a review of the enclosed drawings. For example, the combined exit guide, for example a whipstock, and the section mill, while being illustrated as being threadedly connected, can be an integral tool which performs all of the functions of the two tools when threadedly connected. Moreover, the downhole packer illustrated in FIGS. 4, 5 and 6 may be either hydraulically set by well-known valves and associated hydraulic piping, or the packer may be mechanically set either by weight or by rotation of the tubular in manners well known in the art, or the anchoring device may be something other than a packer and may be any one or more of the anchoring devices well-known in the art of drilling oil and gas wells.

In addition, the combination or integral apparatus contemplated by the present invention can be used in open hole operations having no casing. For example, in an open hole from which either a directional well or a sidetracking operation is to be performed, the section mill can be used to cut out into the rock formation surrounding the wellbore and be used to cut away a portion of the formation as the device is lowered in the wellbore and thus bring the exit guide, or example, a whipstock, into an area from which the well or sidetrack is to be drilled. In addition, when using the apparatus according to the present invention in cased boreholes, the steel casing can be cut away for a longer length to enable the use of magnetic field orientation since the steel casing itself tends to disrupt or hinder the magnetic field orientation process. As is well-known in this art, if the magnetic field orientation does not work, it is considered conventional to use gyros to orient the tool. For that reason, it is well-known to sometimes use the section mill to cut further along the casing to enable magnetic field orientation to be used. Moreover, when attempting to orient the exit guide, for example, a whipstock, in the use of the present invention, if the blades are being set down on either the cut away open hole formation or upon the top of the casing, the entire apparatus has to be lifted up to allow the exit guide to it be oriented because otherwise the blades will prevent the turning of the exit guide to allow the orientation. Once the orientation is established, then the blades can be set back down on top of the cut away open hole formation or upon the top of the steel casing, as the case may be.

Referring again specifically to FIG. 6 of the drawing, when using the integral or combination apparatus in accordance with the invention, the casing is preferably cut away about 60 ft. While this length will vary depending upon the dimension of the tool or tools and the end utility desired, this depth would allow about 40 ft. for the overall length of the exit guide, for example, a whipstock, and about 20 ft. more between the top of the section mill down to about 2–3 ft. below the blades

What is claimed is:

1. An apparatus for sidetracking or drilling directional oil and gas wells, wherein said apparatus is transported through such wells by a string of tubulars, comprising;

a string of tubulars;

a whipstock; and a section mill, said whipstock and said section mill being transported simultaneously through at least one of said wells by said string of tubulars.

2. Apparatus according to claim 1 wherein said whipstock and said section mill comprise an integrated unit.

3. The apparatus according to claim 1 wherein said whipstock and said section mill are separate units but connected together within the apparatus.

4. The apparatus according to claim 1 wherein said section mill is operated by hydraulic fluid passing from the earths's surface through said tubulars and into said section mill.

5. The apparatus according to claim 1 including in addition thereto, an on-off tool carried by said tubular string which allows the tubular string to be connected to or released from said whipstock.

6. The apparatus according to claim 1, including in addition thereto, a downhole packer assembly which can be used to anchor the whipstock and section mill at a determined location within the earth borehole.

7. A method for sidetracking or directional drilling from existing earth wellbores, comprising:

running into the existing wellbore having a pay zone formation surrounding said wellbore a combined whipstock and section mill connected to a string of drill pipe until the section mill is adjacent the pay zone formation surrounding said wellbore;

activating said section mill and lowering said activated section mill until the whipstock located above the section mill is in proximity to the pay zone formation; and running a drill bit connected to a section of drill pipe along the surface of the whipstock and into the formation adjacent said existing wellbore.

8. The method according to claim 7 wherein said existing wellbore is cased.

9. The method according to claim 8 including in addition thereto, the step of anchoring the combined whipstock and section mill to the interior of the wellbore casing prior to running a drill bit along the surface of the whipstock.

10. The method according to claim 9 wherein the section mill has a plurality of section mill blades, and wherein said anchoring step comprises the use of the section mill blades resting on top of the casing adjacent the milled out section of the casing.

11. The method according to claim 9 wherein said anchoring step comprises the use of a downhole packer assembly to anchor the whipstock and the section mill to the interior of the casing.

12. The method according to claim 7 wherein said existing wellbore is uncased.

13. A method for sidetracking or directional drilling from an existing earth wellbore having a pay zone formation surrounding said wellbore, comprising:

running into the existing wellbore a combined whipstock and section mill connected to a string of drill pipe until the section mill is adjacent said pay zone formation;

activating said section mill to mill along said pay zone formation;

transporting said whipstock until said whipstock is in proximity to said pay zone formation; and running a drill bit connected to a string of drill pipe along the surface of the whipstock and into the pay zone formation surrounding said wellbore.

14. A method for sidetracking or directional drilling from an existing earth wellbore into the earth formation surrounding said borehole, comprising:

running into the existing wellbore a combined whipstock and section mill connected to a string of drill pipe until the section mill is located at a first predetermined depth in said wellbore;

activating said section mill to mill along from said first predetermined depth to a second predetermined depth in said borehole;

transporting said whipstock through said well until said whipstock is in proximity to the earth formation surrounding said borehole between said first and second predetermined depths in said borehole; and running a drill bit connected to a string of drill pipe along the surface of the whipstock and into the earth formation surrounding said wellbore.

15. The method according to claim 14 wherein said wellbore is cased.

16. The method according to claim 14 wherein said wellbore is uncased.

* * * * *